US009456672B2

(12) United States Patent
Condon et al.

(10) Patent No.: US 9,456,672 B2
(45) Date of Patent: Oct. 4, 2016

(54) REUSABLE SHOPPING BAG STORAGE AND DISPENSING SYSTEM

(71) Applicants: Donna Condon, Watsonville, CA (US); Anthony Christopher Condon, Watsonville, CA (US)

(72) Inventors: Donna Condon, Watsonville, CA (US); Anthony Christopher Condon, Watsonville, CA (US)

( * ) Notice: Subject to any disclaimer, the term of this patent is extended or adjusted under 35 U.S.C. 154(b) by 0 days.

(21) Appl. No.: 14/507,512

(22) Filed: Oct. 6, 2014

(65) Prior Publication Data

US 2015/0020935 A1 Jan. 22, 2015

Related U.S. Application Data

(63) Continuation-in-part of application No. 14/196,663, filed on Mar. 4, 2014.

(60) Provisional application No. 61/772,123, filed on Mar. 4, 2013.

(51) Int. Cl.

| | |
|---|---|
| ***B65H 1/00*** | (2006.01) |
| ***A45C 1/02*** | (2006.01) |
| ***A45F 5/02*** | (2006.01) |
| ***A45C 1/06*** | (2006.01) |
| ***A45C 3/04*** | (2006.01) |
| ***A45C 7/00*** | (2006.01) |
| ***A45C 9/00*** | (2006.01) |
| ***A45C 11/18*** | (2006.01) |
| ***A45C 13/02*** | (2006.01) |

(52) U.S. Cl.

CPC ..... *A45C 1/02* (2013.01); *A45C 1/024* (2013.01); *A45C 1/06* (2013.01); *A45C 3/04* (2013.01); *A45C 7/0077* (2013.01); *A45C 9/00* (2013.01); *A45C 11/182* (2013.01); *A45C 13/023* (2013.01); *A45F 5/021* (2013.01); *A45C 2001/022* (2013.01); *A45C 2001/065* (2013.01); *A45C 2009/007* (2013.01); *A45F 2200/055* (2013.01); *A45F 2200/0558* (2013.01)

(58) Field of Classification Search

CPC .. B65D 83/0805; A45C 13/001; A45C 1/02; A45C 3/06

USPC ..... 5/420; 221/1, 33; 150/106

See application file for complete search history.

(56) References Cited

U.S. PATENT DOCUMENTS

| | | | | | |
|---|---|---|---|---|---|
| 2,020,556 | A | * | 11/1935 | Kirkpatrick | D04B 3/06 139/389 |
| 2,038,952 | A | * | 4/1936 | Niedorff | A45C 3/07 224/218 |
| 2,863,365 | A | * | 12/1958 | Piazze | B31B 19/90 383/75 |
| 3,690,221 | A | * | 9/1972 | Schmedding | B65D 31/08 383/10 |

(Continued)

*Primary Examiner* — Rakesh Kumar

(74) *Attorney, Agent, or Firm* — Donald R. Boys; Central Coast Patent Agency, Inc.

(57) ABSTRACT

A shopping organizer comprises a purse or handbag enabled to carry cards and money, a carrier enclosure separate from the purse or handbag, attached to the purse or handbag, the carrier enclosure having a dispensing opening on one end, and a plurality of shopping bags, each formed from a material having a low coefficient of friction and capable of sustaining permanent fold creases, the shopping bags folded along the creases and arranged in a stack held together by a strap, the stack of shopping bags placed in the carrier enclosure such that individual ones of the plurality of bags may be grasped and pulled out of the stack through the dispensing opening.

9 Claims, 13 Drawing Sheets

(56) References Cited

U.S. PATENT DOCUMENTS 4,988,216 A * 1/1991 Lyman ..... A45C 11/20 383/110
5,046,860 A * 9/1991 Brennan ..... A45C 13/02 150/111
5,182,895 A * 2/1993 Lugo ..... B65B 61/26 206/459.5
5,209,385 A * 5/1993 Ledesma ..... A45C 1/04 224/223
5,402,869 A * 4/1995 Saltzman ..... A45C 7/0086 150/113
6,427,839 B1 * 8/2002 Helfer-Grand ..... A45C 3/00 150/112
D571,102 S * 6/2008 Gostt ..... D3/244
7,614,100 B1 * 11/2009 Barrington et al. ..... 5/420
8,342,750 B2 * 1/2013 Heinlen ..... B65D 31/04 383/2
2004/0004013 A1 * 1/2004 Dleter ..... A47K 10/3827 206/409
2005/0028910 A1 * 2/2005 Duty ..... 150/128
2011/0314608 A1 * 12/2011 Rovin ..... A47D 5/006 5/655
2012/0241463 A1 * 9/2012 Zimmerman ..... B65D 5/542 221/1
2012/0243806 A1 * 9/2012 Parks ..... A45C 3/04 383/72
2014/0101848 A1 * 4/2014 Murphy ..... A47G 9/08 5/420

* cited by examiner

REUSABLE SHOPPING BAG STORAGE AND DISPENSING SYSTEM

CROSS-REFERENCE TO RELATED DOCUMENTS

The present application is a Continuation-in-Part of the U.S. application Ser. No. 14/196,663, filed Mar. 4, 2014, which claimed priority to U.S. provisional application Ser. No. 61/772,123, filed Mar. 4, 2013, entitled "Reusable Shopping Bag Storage and Dispensing System". The entire disclosures of the parent applications are incorporated herein in their entirety at least by reference.

BACKGROUND OF THE INVENTION

1. Field of the Invention

The present invention is in the field of systems for storage and organization for presentation of other articles, and pertains more particularly to organizing shopping tools including reusable shopping bags.

2. Discussion of the State of the Art

It is well known that many municipalities have enacted ordinances to limit or eliminate the use of plastic and or paper bags, and also to authorize grocery stores and other enterprises to charge for paper bags. These new ordinances bring about distaste and inconvenience in the shopping experience. Not only do shoppers have to pay expensive prices for groceries, they also have to pay up to twenty-five cents per bag. As a result it has become desirable for shoppers to bring their own bags, such as reusable cloth bags, when visiting a retail establishment that may charge for bags to carry purchased items away.

The inventor is aware of a storage and dispensing enclosure system listed in the cross-reference section of this specification that may be used to hold a plurality of shopping bags in a manner that bags may be individually withdrawn and used to hold a plurality of purchased items and then reinserted with a high degree of organization in a small footprint resulting in a unique form factor. It has occurred to the inventor that a shopping bag storage system such as one reference above may be lost or forgotten by a user.

Therefore, what is clearly needed is a wearable shopping organizer that includes facilities for organizing shopping tools and other articles and for organizing shopping bags for immediate use while shopping.

BRIEF SUMMARY OF THE INVENTION

In one embodiment of the invention a shopping organizer is provided, comprising a purse or handbag enabled to carry cards and money, a carrier enclosure separate from the purse or handbag, attached to the purse or handbag, the carrier enclosure having a dispensing opening on one end, and a plurality of shopping bags, each formed from a material having a low coefficient of friction and capable of sustaining permanent fold creases, the shopping bags folded along the creases and arranged in a stack held together by a strap, the stack of shopping bags placed in the carrier enclosure such that individual ones of the plurality of bags may be grasped and pulled out of the stack through the dispensing opening.

In one embodiment the shopping organizer further comprises a shoulder strap such that the purse or handbag may be slung from a user's shoulder. In one embodiment the shopping organizer further comprises one or more belt loops enabling a user to carry the purse or handbag slung from a belt. In one embodiment the carrier enclosure has a dispensing opening at opposite ends. Also in one embodiment the dispensing opening is closable by one of a drawstring, a zipper, or a folding flap. In one embodiment the carrier enclosure comprises a zipper opening along a length of the enclosure for inserting the stack of shopping bags into the carrier enclosure, and in one embodiment the shoulder strap is fastened at each end to one end of the purse or handbag.

In one embodiment the carrier enclosure is mounted to the purse or handbag by a releasable mechanism, such that the enclosure may be released and separated from the purse or handbag, and in one embodiment a shoulder strap is fastened at one end to the purse or handbag, and at the other end is fasted to the carrier enclosure.

BRIEF DESCRIPTION OF THE SEVERAL VIEWS OF THE DRAWINGS

FIG. 2(*b*) is an illustration of a stack of folded shopping bags in an embodiment of the present invention.

DETAILED DESCRIPTION OF THE INVENTION

In various embodiments described in enabling detail herein, the inventor provides a wearable shopping organizer. The present invention is described using the following examples, which may describe more than one relevant embodiment falling within the scope of the invention.

Figure 1:
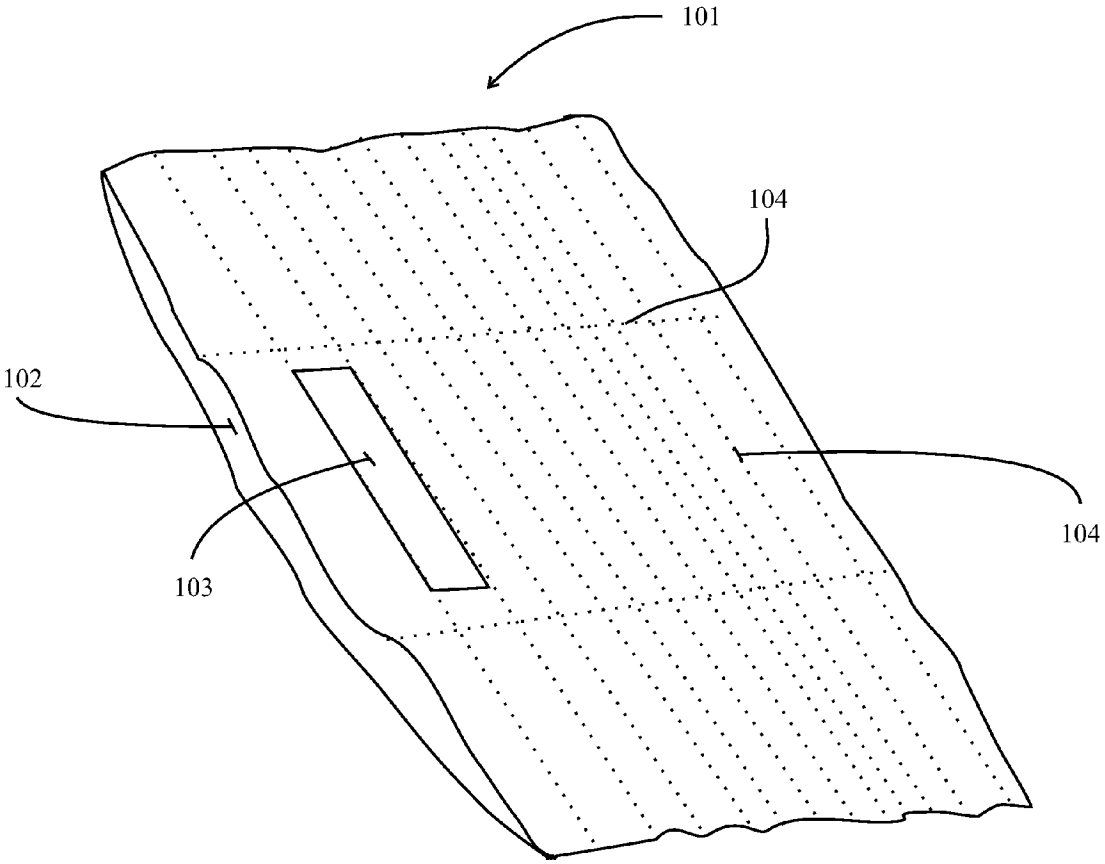
FIG. 1 is an illustration of a shopping bag exemplary of the type of bag suitable for shopping bags in an embodiment of the present invention.

FIG. 1 is an illustration of a shopping bag exemplary of the type of bag suitable for shopping bags in an embodiment of the present invention. Shopping bag 101 is made from a material with a low coefficient of friction to other materials. In one embodiment the material is silk. In another embodiment the material is ripstop nylon. In one embodiment shopping bag 101 is made of silnylon, which is a form of ripstop nylon incorporating silicone. Ripstop fabrics are woven fabrics, often made of nylon, using a special reinforcing technique that makes them resistant to tearing and ripping. During weaving, reinforcement threads are interwoven at regular intervals in a crosshatch pattern. The intervals are typically 5 to 8 millimeters (0.2 to 0.3 in). Thin and lightweight ripstop fabrics have a 3-dimensional structure due to the thicker threads being interwoven in thinner cloth. Older lightweight ripstop fabrics display the thicker interlocking thread patterns in the material quite prominently, but more modern weaving techniques make the ripstop threads less obvious.

Another characteristic of bag 101 is that when the material is folded, permanent fold creases 104 may be formed which enhance the ability of the bag to be accurately folded and re-folded along these creases. Once folded the material maintains the creases very well and facilitates refolding once the shopping bag is emptied. This folding memory enhances the ability of the user to refold the bag into its preferred shape for reinsertion info a container.

In FIG. 1 a handle 103 may be incorporated. Handle 103 is used to facilitate carrying bag 101. Handle 103 may be made of various materials therefore the type of material is not intended to be a limitation rather any material can be used for handle 103 and bag 101. Element 102 indicates a single opening into the shopping bag.

Figure 2A:
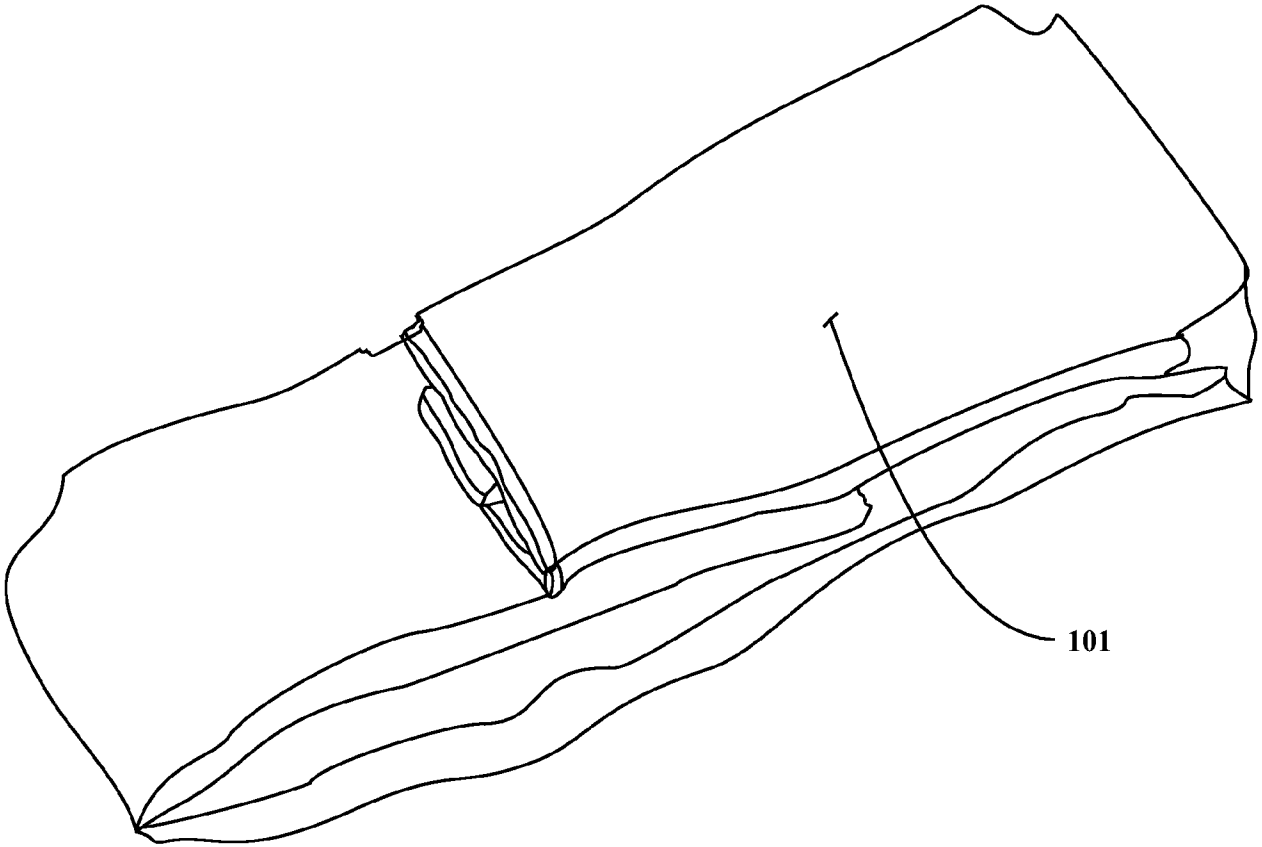
FIG. 2(*a*) is an illustration of a folded shopping bag exemplary of the type of bag suitable for shopping bags in an embodiment of the present invention.
Figure 2B:
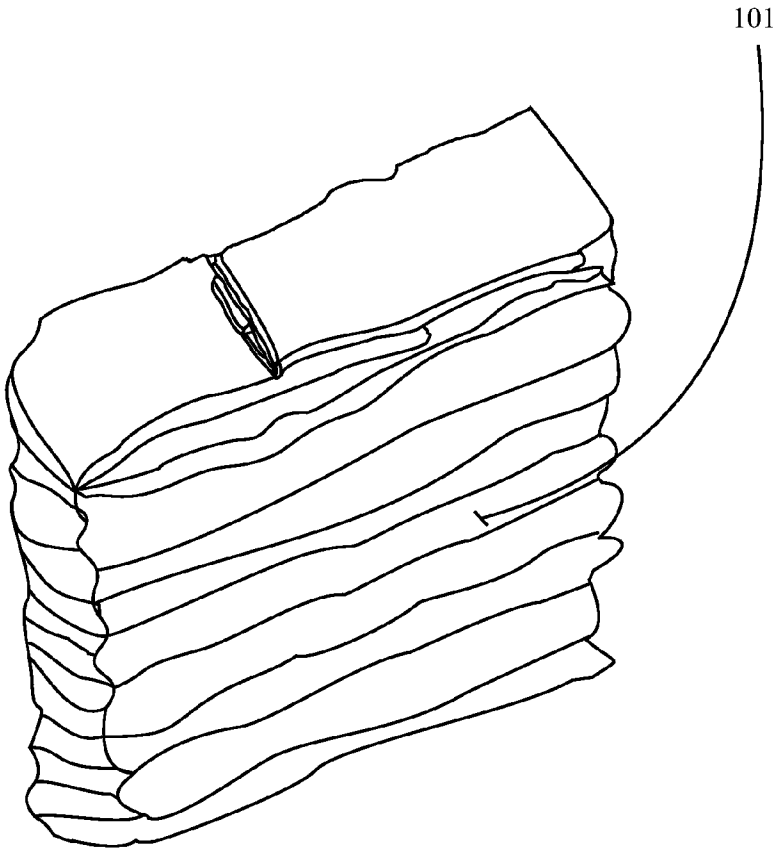

FIG. 2(*a*) illustrates shopping bag 101 folded along folding lines 104 (shown in FIG. 1) which may produce a compact folded bag. Several bags 101 may be stacked together in practicing the present invention as illustrated in FIG. 2(*b*).

Figure 3:
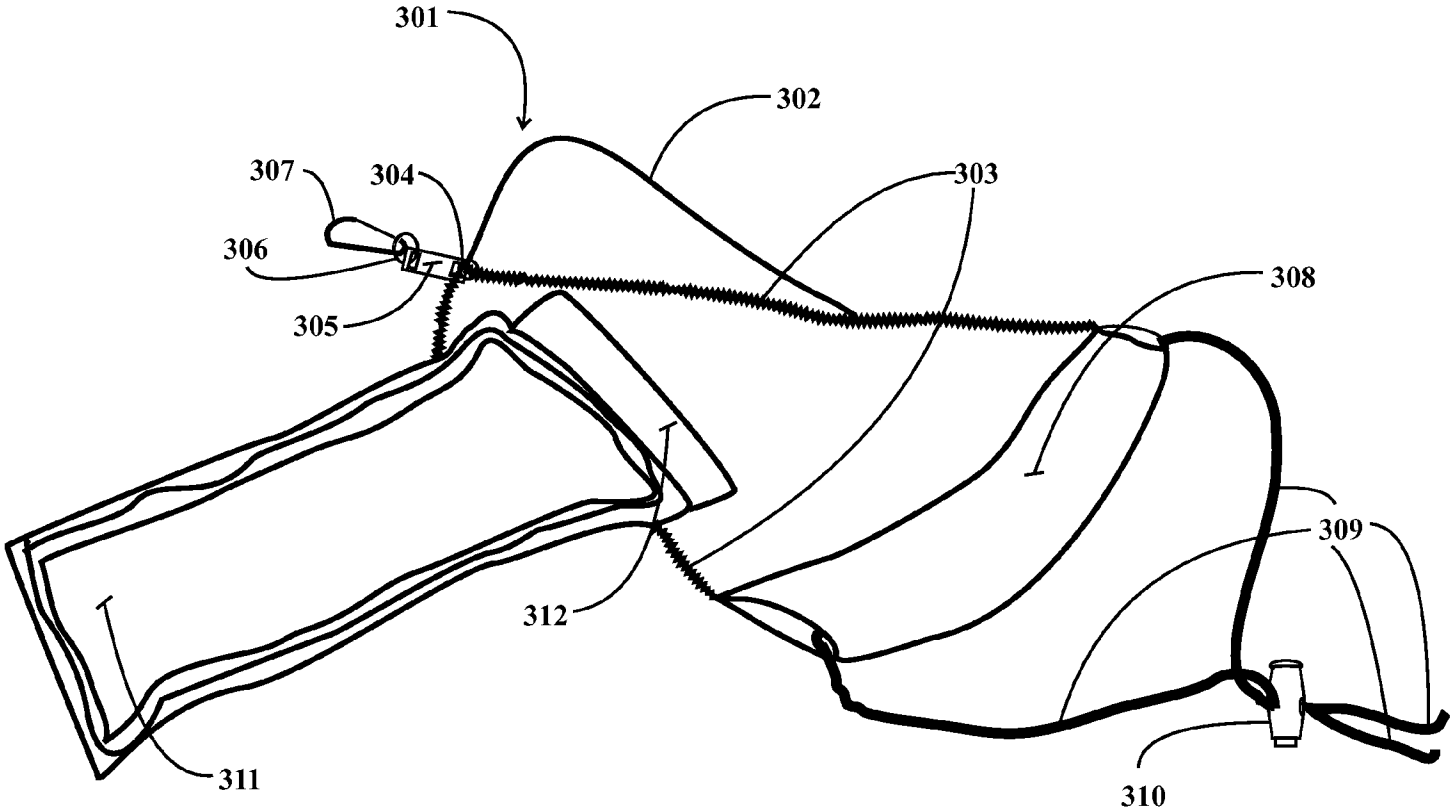
FIG. 3 Illustrates a shopping bag container opened to receive folded bags according to one embodiment of the present invention.

FIG. 3 illustrates a storage bag 301 opened fully, prior to wrapping and storing shopping bags 101. Storage bag 301 has an outer skin 302 which may form a cylindrical tube when a zipper 303 is drawn closed. Drawing zipper 303 closed may be achieved by a user grasping a pull tab 305 and dragging an attached zipper slider 304 along to mesh the zipper's teeth to seal most of the length of the storage bag 301. In some embodiments closure of storage bag 301 may accomplished via buttons, Velcro™, or by some other means. Outer skin 302 may also be made from a variety of pliable materials such as natural or artificial fiber, cloth, plastic, hessian or metal chain mesh, for example, depending at least in part upon strength required, weight consideration, availability or fabrication cost factors. Fabric of outer skin 302 may also be intrinsically waterproof or treated with a waterproofing agent.

In one embodiment there is a carabineer 307 connected to pull tab 305 via a split ring 306. One purpose of attaching carabineer 307 to the present invention may be to enable storage bag 301 to be attached to another object such as, for example, a shopping cart. This may allow a user to carry storage bag 301 without the use of hands. One purpose of using split ring 306 may be to ensure that carabineer 307 is not easily detached from pull tab 305.

In one embodiment outer skin 302 may not be fully enclosed by zipper 303 along the total length of storage bag 301. This allows a non-zippered portion of outer skin 302 to retain an open flange section 308 when zipper 303 is fully drawn in the closed position. In one embodiment providing open flange section 308 may assist in dispensing the stacked bags shown in FIG. 2(*b*). In another embodiment storage bag 301 may also incorporate drawstring 309 which may loop through the ends of each side of outer skin 302. Drawstring 309 may then be drawn tight to constrain the stacked bags shown in FIG. 2(*b*). Drawstring 309 may have a locking mechanism such as a spring-loaded drawstring gripping element 310. In one embodiment drawstring-gripping element 310 may be used to keep drawstring 309 in the fully drawn position or any other convenient position.

FIG. 3 further illustrates a constraining element 311 which may be used to surround and constrain folded and stacked shopping bags (shown as element 101 in FIG. 2(*b*) and hold them together inside storage bag 301. Constraining element 311 is further discussed below with reference to FIG. 4.

Figure 4:
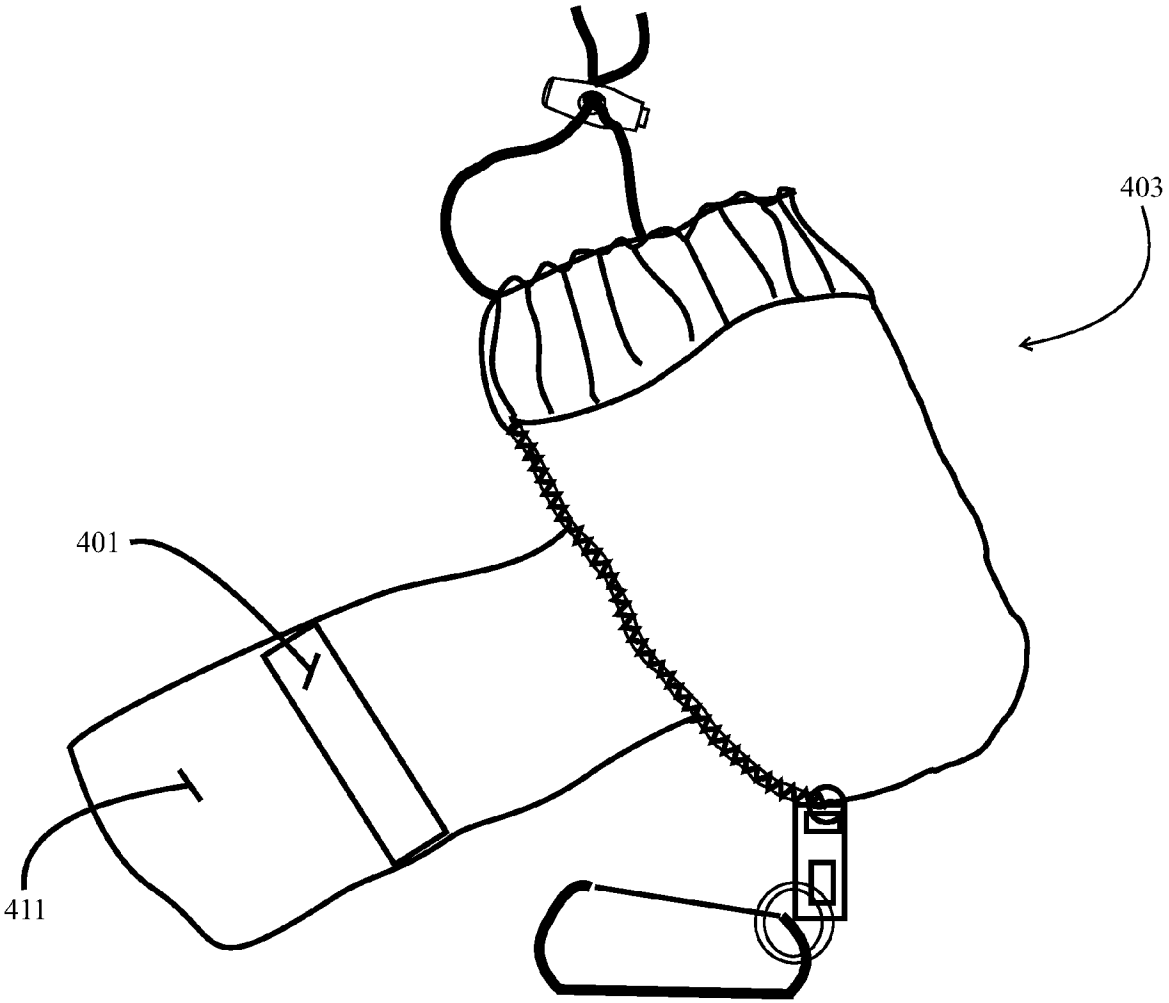
FIG. 4 illustrates a storage bag container according to one embodiment of the present invention.

FIG. 4 illustrates a storage bag container according to one embodiment of the present invention. Constraining element 411, equivalent to element 311 of FIG. 3, may incorporate a Velcro strip 401 attached to the exterior of constraining element 411. Velcro strip 401 is adapted to join with an internal Velcro securing strip (shown as element 312 of FIG. 3) to constrain and secure a plurality of pre-folded and stacked shopping bags inside storage bag 403. Constraining element 411 may be attached to the inside of storage bag 401 by various means. In one embodiment element 411 is sewn to the inside of storage bag 403. In other embodiments it is attached via a plurality of buttons, fasteners, of by any other convenient means.

In other embodiments constraining element 411 may be a separate element such that a user may wrap folded bags separately. In this circumstance a user might have two or more stacks of folded bags, so when one set is dispensed completely, it is only necessary to place another pre-prepared set of folded bags into the storage bag 403.

Figure 5:
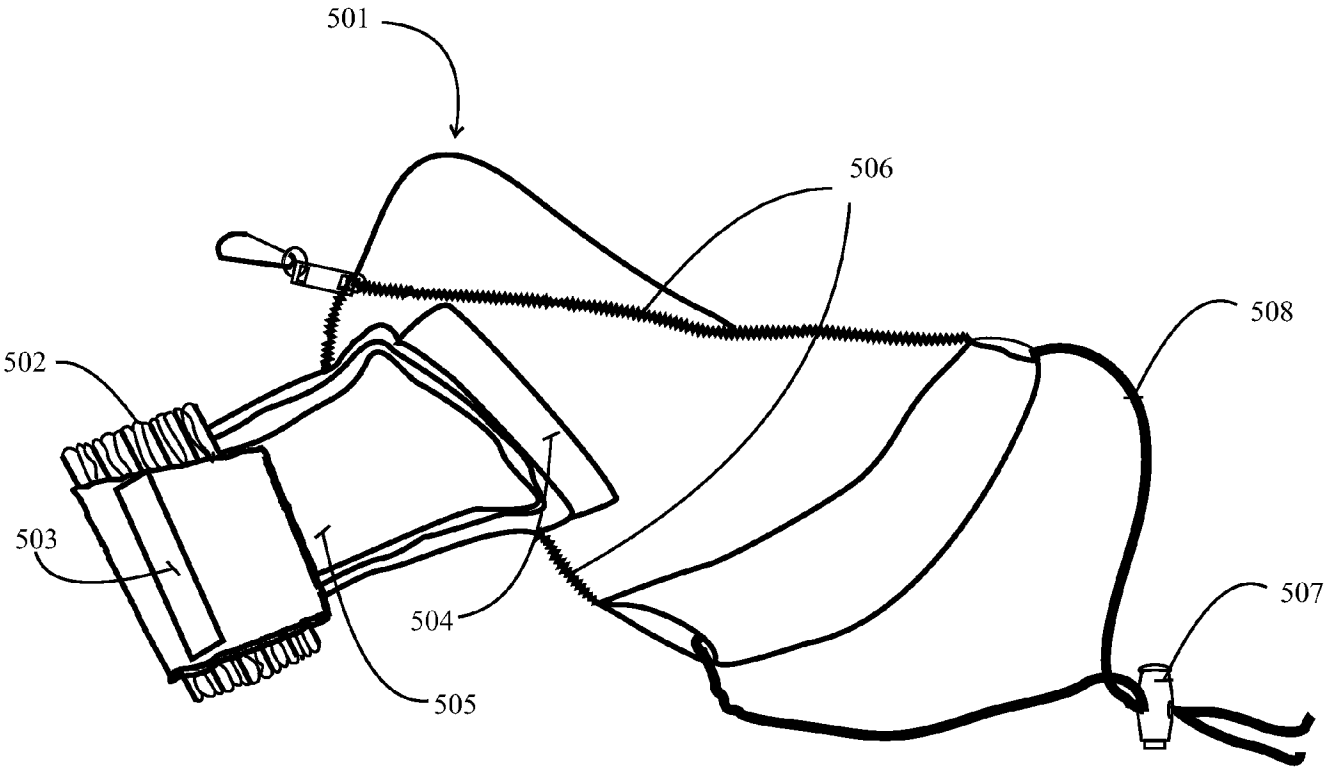
FIG. 5 illustrates a shopping bag container holding shopping bags according to one embodiment of the invention.

FIG. 5 illustrates a shopping bag container holding shopping bags according to one embodiment of the invention. In this embodiment a stack of pre-folded shopping bags 502 are wrapped with constraining element 505. Constraining element 505 surrounds a plurality of pre-folded shopping bags 502 such that continued rolling or folding of constraining element 505 will cause Velcro strip 503 to adhere to Velcro pad 504 thereby constraining the pre-folded shopping bags to the interior of storage bag 501. Once the pluralities of bags are constrained to the interior of storage bag 501 the storage bag may be zipped up via zipper 506. Once storage bag 501 is zipped up, spring-loaded drawstring gripping element 507 is grasped and drawstring 508 is pulled there through causing storage bag 501 to close around the plurality of previously constrained bags 502. It is known to the inventor that other methods of constraining shopping bags 502 in storage bag 501 may be used therefore the method of constraint of FIG. 5 is exemplary in nature and not intended to be limiting. For example, a hook and eye linking mechanism may be appropriate for this purpose and therefore other securing mechanisms could be used.

Figure 6:
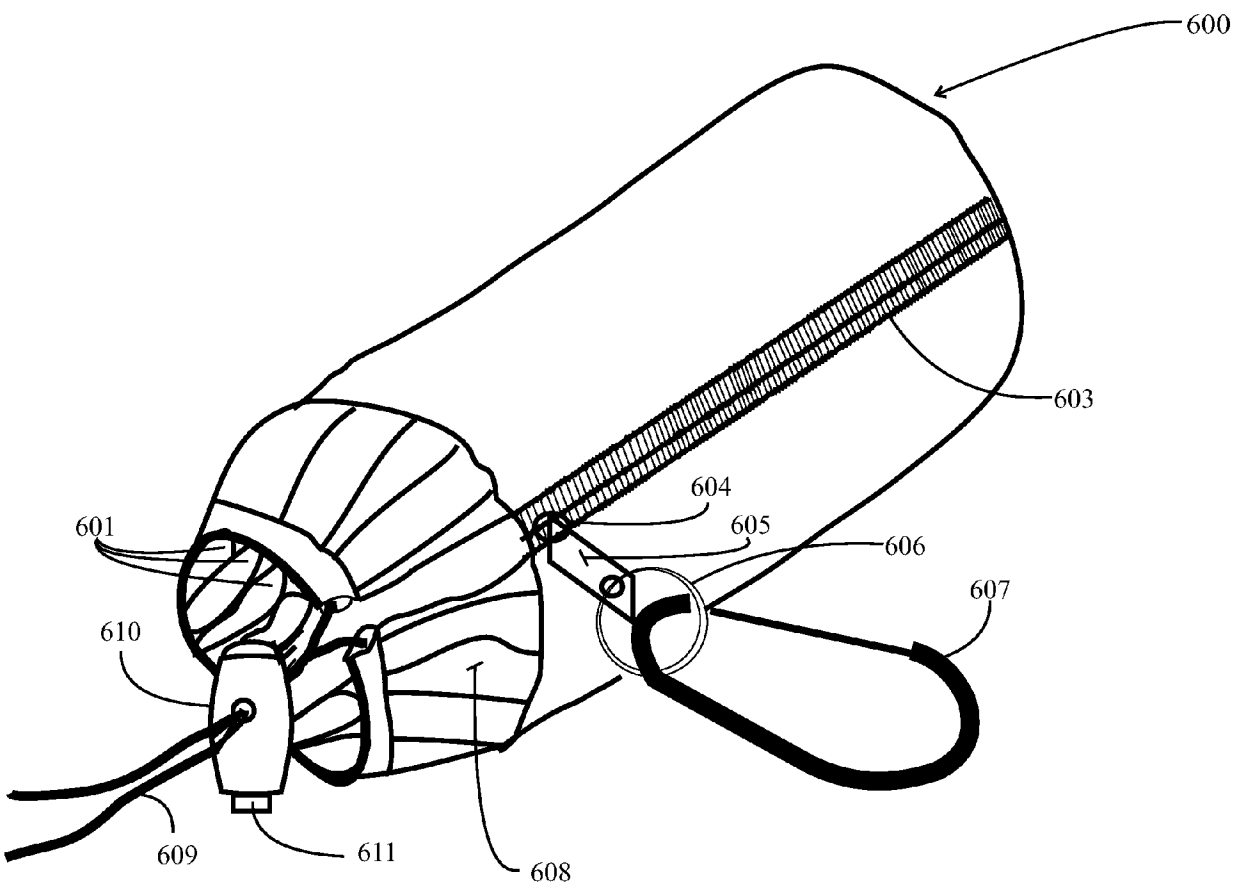
FIG. 6 illustrates a closed shopping bag container enclosing a plurality of folded shopping bags according to one embodiment of the present invention.

FIG. 6 is an illustration of a storage bag 600 containing a plurality of shopping bags 601, the storage bag containing the shopping bags in the closed position. Flange opening 608 may assist in dispensing stacked bags 601 by widening the storage bag opening. A user may open storage bag 600 to this position by loosening spring-loaded drawstring gripping element 610 by pressing spring loaded button 611 and loosening drawstring 609 sufficiently to expose the ends of stacked shopping bags 601, which may allow a user to extract one bag at a time to, for example, hand over each bag to a cashier to pack purchased items. Zipper elements 603, 604, 605, 606 do not have to be used in the store as the shopping bags may be accessed by the method discussed above thereby providing a convenience not previously afforded shoppers. In this closed position the shopping bag storage system has a small profile such that the whole unit may be carried in a purse or snapped via carabineer 607 to a belt loop, shopping cart or other such convenient place.

Figure 7:
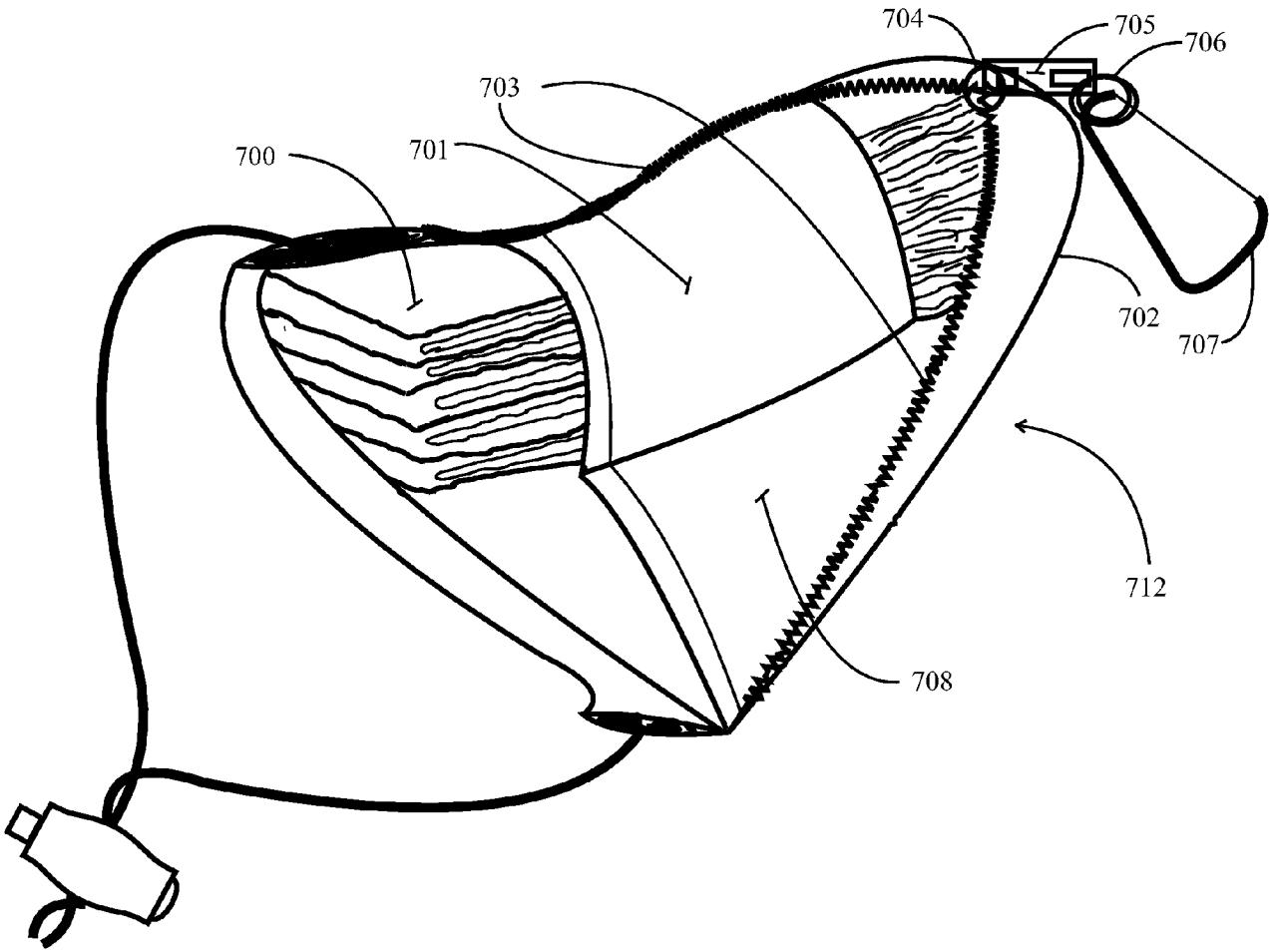
FIG. 7 illustrates an open shopping bag container illustrating an internal bag enclosing member according to one embodiment of the present invention.

FIG. 7 illustrates an open shopping bag container system 712 illustrating an internal bag constraining member 701 according to one embodiment of the present invention. In this view a plurality of pre-folded shopping bags 700 are shown wrapped and secured via Velcro (discussed earlier) within constraining element 701. Constraining element 701 is firmly attached via sewing or glue, or any other method, to contiguous material 708. Material 708 is attached to the interior of storage bag 702. The attachment of a fairly large portion of material 708 to the inside of storage bag 702 insures a very strong marriage of the materials.

When a user is done shopping and has emptied all of the shopping bags of groceries or other items, the user may re-fold the bags 700 and wrap them in constraining element 701 such that they are attached to the interior of storage bag 702 once again. Once this is done the user will zip up bag 702 via zipper 703. Zipper 703 is attached to bag 702 by a number of standard means which may include sewing, gluing etc. . . . . A zipper sliding body (not shown) causes the material of storage bag 702 to come together when urged towards the top of storage bag 702. Zipper sliding body (not shown) is attached to zipper tab 705 via ring 704. Zipper tab 705 is further attached to another ring 706 which facilitates attachment to carabineer 707 to facilitate attachment to shopping cart etc. . . . .

Figure 8:
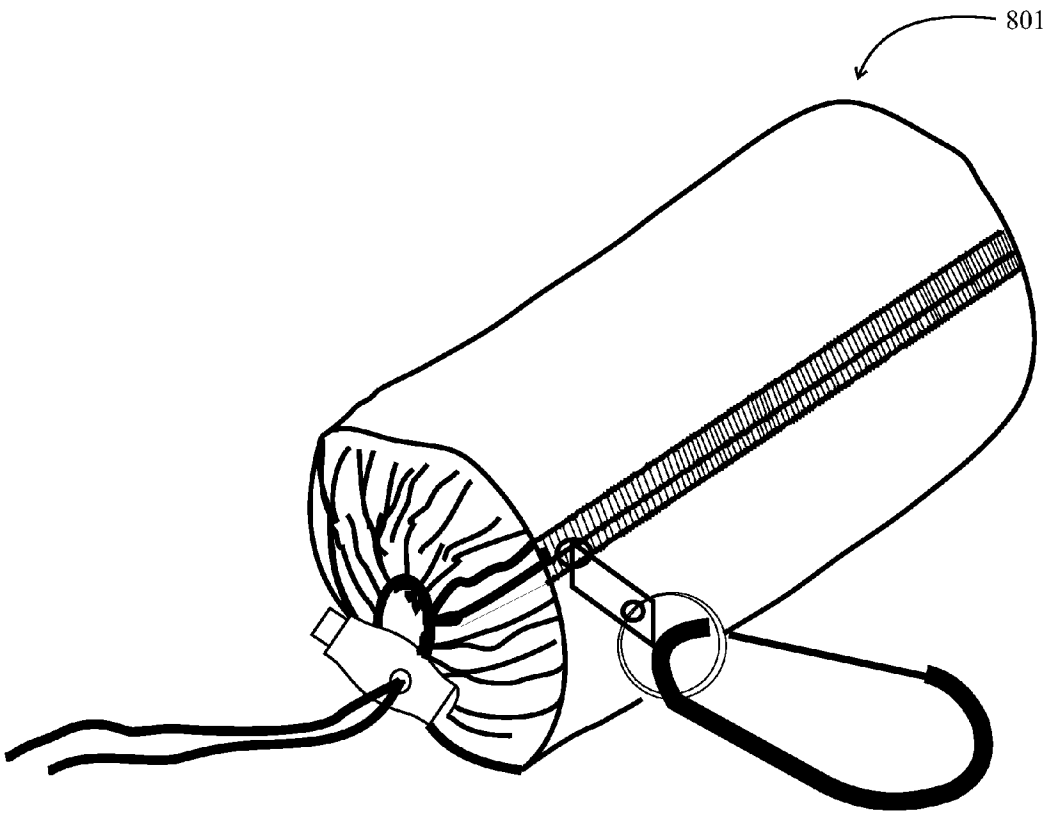
FIG. 8 illustrates a closed shopping bag container system according to one embodiment of the present invention.

FIG. 8 is a perspective view of storage bag system 801 fully zippered and closed. One experienced in the art will recognize the advantage of the compact form factor, which can enclose from a few to many shopping bags. The packaged bags can be carried in a pocket of a jacket, in a purse, in the pocket of a pair of jeans or just clipped to a loop of any material that is part of the clothing or clothing accessory, or clipped to a portion of a shopping cart. The packaged bags might be implemented in a wide variety of bag sizes, depending in part upon the many purposes of the invention, and therefore other dimensions could be used which should not be construed as limiting the scope of the invention.

Figure 9:
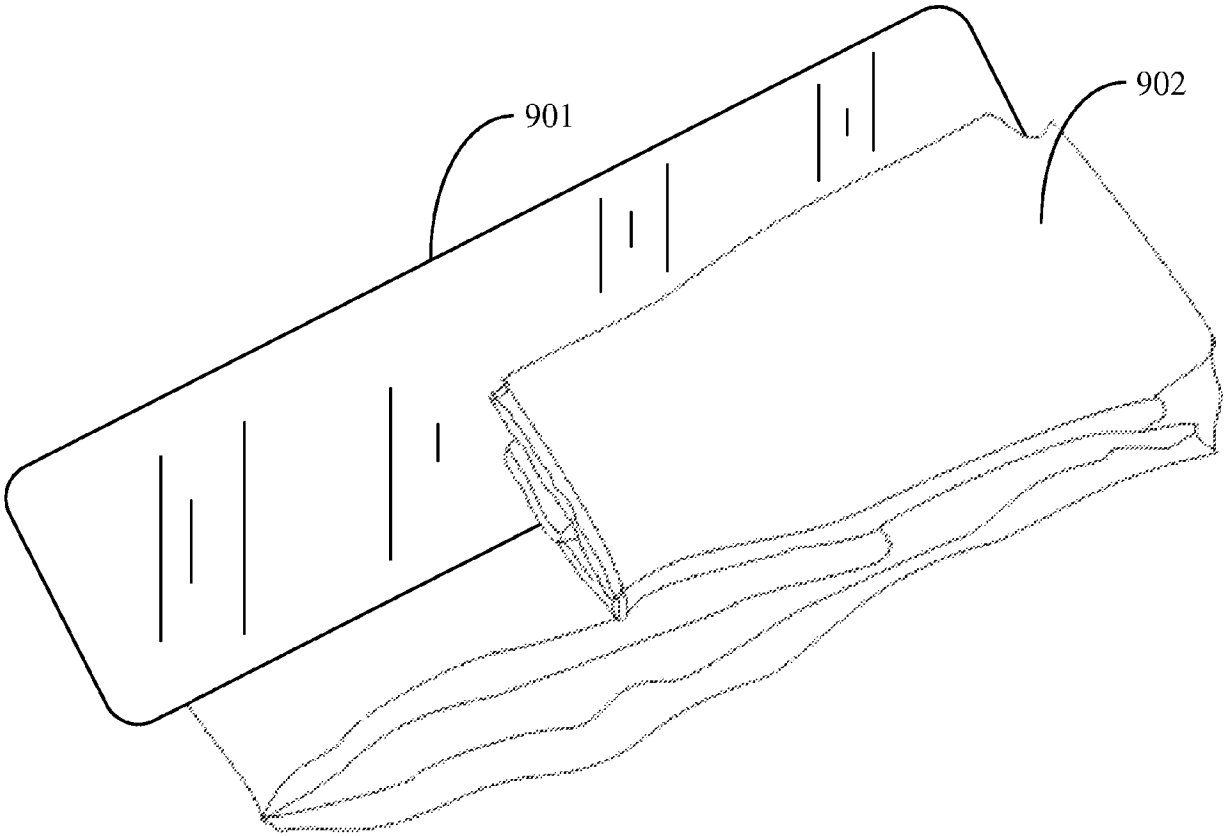
FIG. 9 illustrates a shopping bag folded over an insertion element prior to insertion into shopping bag container according to one embodiment of the present invention.

FIG. 9 is an illustration of a shopping bag insertion method according to an embodiment of the present invention. Element 901 is a bag insertion element. This element is made from a sufficiently thin stiff material. The material may be plastic, wood, polyurethane, polyvinyl chloride plastic, ABS plastic or any other material capable of urging shopping bag 902 into a storage bag. In one embodiment the insertion element 901 is a plastic, solar charged calculator. The shopper may use this to calculate groceries prices and check totals at check out. In one embodiment the insertion element is an Internet connected device capable of checking prices of grocery items against other sellers. In another embodiment the insertion element is capable of scanning skews of grocery items and comparing them to other sellers or totaling items at checkout. In another embodiment the insertion device is a computerized appliance. A shopper scans the groceries with said appliance and utilizes a self-check out, the self-checkout tallying the groceries from the previously scanned groceries.

Figure 10:
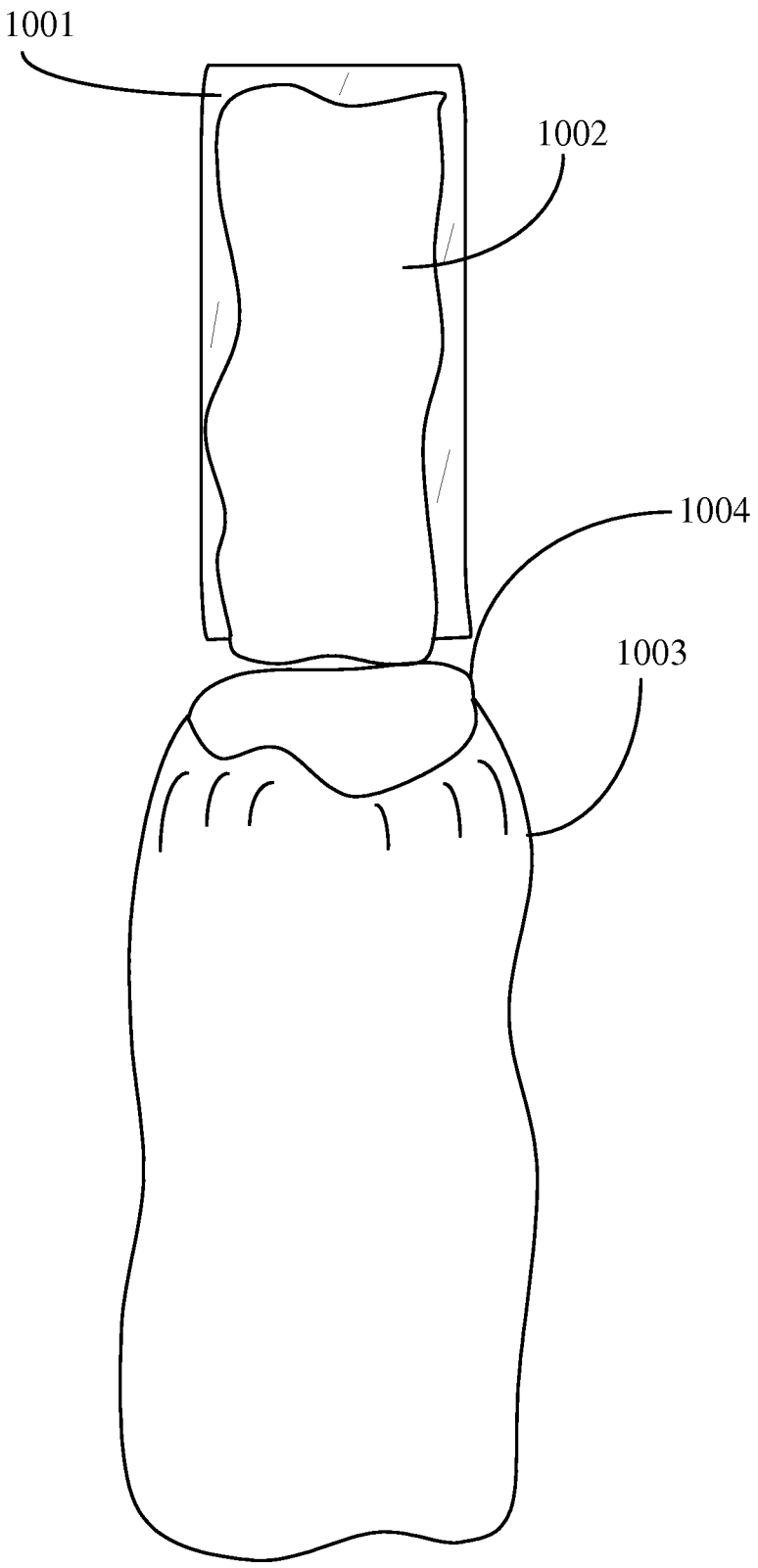
FIG. 10 illustrates a shopping bag folded over an insertion element prior to insertion into shopping bag container according to one embodiment of the present invention.

FIG. 10 is an illustration of an insertion device according to an embodiment of the present invention. In this embodiment storage bag 1003 is made of an elastic material. Pre-folded shopping bag 1002 is folded over insertion device 1001 enabling shopping bags to be inserted into storage bag 1003 very easily. The pre-folded bag 1002 being made of very slippery material as mentioned earlier in this specification. In this embodiment only a one-piece storage bag is necessary with no need for a zipper or a constraining element. In another embodiment the rim of storage bag 1003 is formed into an elastic closure. In practice shopping bag 1002 is folded over plastic insertion element 1001. Because of the stiffness of insertion element the elastic closure 1004 is forced open to receive shopping bag 1002. Once insertion element is removed the elastic storage bag and elastic closure close around previously inserted shopping bag 1002. A plurality of shopping bags may be inserted in this way into storage bag 1003. Once inserted all bags are securely held in storage bag 1003 and may be removed and re-inserted easily.

Wearable Shopping Organizer

In one embodiment the inventors provide a shopping organizer that includes compartments for organizing such as debit and credit cards, paper money and coins, checks, keys and other items together with a version of a shopping bag organizer such as described above in this specification.

Figure 11:
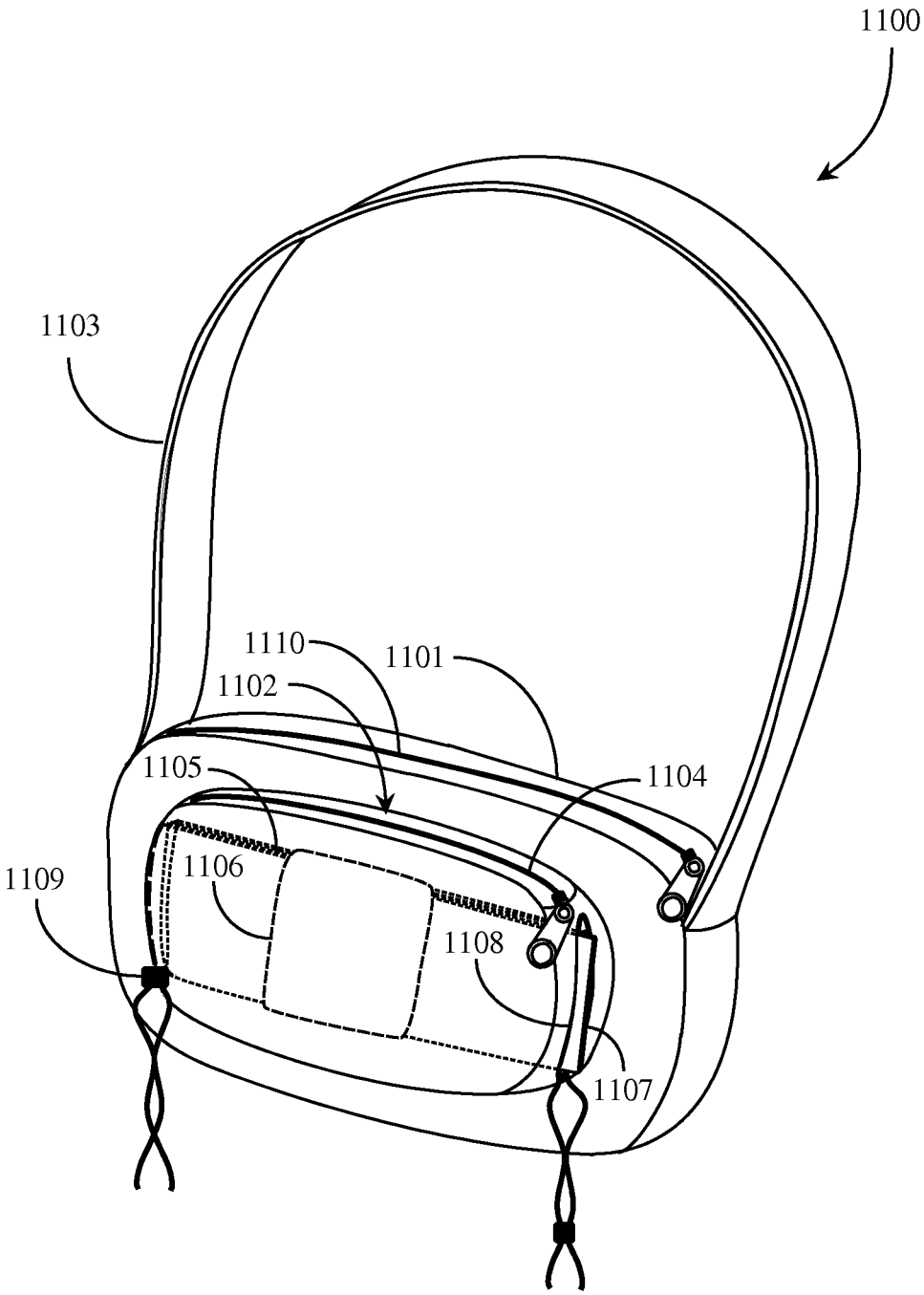
FIG. 11 is a perspective view of a shopping organizer according to an embodiment of the present invention.

FIG. 11 is a perspective view of a shopping organizer 1100 according to an embodiment of the present invention. Shopping organizer 1100 may be provided in the form of a shoulder-carried purse or bag that may be worn by a shopper over the shoulder via a shoulder strap 1103. Shopping organizer 1100 may be fabricated from any pliable to semi-rigid materials such as leather, polymers, and heavy fabrics. Shopping organizer 1100 includes an enclosure 1101 having an internal volume and an openable top portion, which in this example, is openable via a zipper 1110, such as well-known for a wide variety of purses and hand bags in the art.

Inside enclosure 1101, as is known for such enclosures, there may be additional pockets and compartments (not illustrated but assumed present) for organizing articles like paper money and coins, keys, a calculator, including those articles used in a shopping experience such as credit, debit, and membership cards and saved coupons. Such pockets and compartments may be fabricated from a durable material and sewn into the material making up the inner walls of compartment 1101. In another embodiment, compartments may be provided in a separate material such as plastic and attached to the inside walls of organizer 1101. In this example, enclosure 1101 may be opened via a zipper 1110. Other ways to open and close enclosure 1101 may also be provided without departing from the scope of the invention, such as an overhead flap attached to one side or the bag that may fold over the opening and may be latched or otherwise secured at the opposite side of enclosure 1101.

In this embodiment a second enclosure 1102 is provided joined to the first enclosure in the form of a shopping bag carrier. Shopping bag carrier 1102 may be fabricated of a material the same or similar to that described above with respect to organizer 1101. Shopping bag carrier 1102 is, in some embodiments, smaller in volume and length than first enclosure 1101. The size relationship between the first enclosure and the shopping bag carrier may vary widely without departing from the spirit and scope of the invention. The actual size of carrier 1102 with respect to enclosure 1101 may depend in part of the dimensions of the shopping bags carried in carrier 1102. Carrier 1102 may assume a wide variety of shapes or profiles. In this example carrier 1102 is more like a compartment having a front and back side as well as a top and bottom. In another embodiment carrier 1102 may be more tubular in construction like bag 600 described further above with reference to FIG. 6 of this specification. In another embodiment the implementation may be round or oval.

Shopping bag carrier 1102 in this example has at least one open or openable end 1108 through which a folded shopping bag 1107 is visible protruding from the open end. In this example, the opposing ends of carrier 1102 have similar openings so that a stack of folded shopping bags 1105, including bag 1107, may be accessed from either end. In this way it may be convenient for users to retrieve a shopping bag from organizer 1100 whether right or left handed.

Shopping bag 1107 is analogous to shopping bag 101 with reference to FIG. 1 described above. Like bag 101, bag 1107 is in some embodiments made from a material with a low coefficient of friction to other materials. Materials may include silk, ripstop nylon, silnylon, which is a form of ripstop nylon incorporating silicone, among others. Rip stop fabrics are described in detail further above with reference to FIG. 1. In this example, shopping bag 1107 is one of several bags 1105 that are folded and wrapped in stack formation within carrier 1102. In this embodiment there are two open or openable ends on opposing ends of carrier 1102. The open ends may be closeable via a drawstring having a button brake or stop such as stop 1109. Bag carrier 1102 may also comprise an openable top facilitating convenient insertion of a folded, stacked and wrapped assembly of shopping bags. In this embodiment, the top opening is closeable via a zipper 1104.

A material wrap 1106 may be provided to wrap around the stack of folded shopping bags including bag 1107. In one embodiment wrap 1106 may be sewn or otherwise attached to the inside of shopping bag organizer 1102. In this embodiment however, wrap 1106 is a separate piece of material used to wrap the bags before inserting the folded stack of bags 1105 into carrier 1102. Wrap 1106 may have a hook and loop connector fashioned on the ends of the wrap for securing the wrap about a stack 105 of shopping bags. Other methods of securing wrap 1106 about a stack of folded shopping bags may also be implemented without departing from the spirit and scope of the invention, such as snap connectors, magnetic connectors, button connectors, etc. In one embodiment the folded stack of bags may be inserted into shopping bag carrier 1102 with the aid of a shim made of a stiff thin material analogous in description and potential features to insertion element 901 of FIG. 9.

A user may insert an appropriate variety of cash, cards, and other documentation into shoulder bag 1101 and may stock carrier 1102 with a fresh folded and wrapped stack of shopping bags 1105. The number of bags stacked is arbitrary and based on needs of the user, as well as size and capacity of carrier 1102. The user may grasp and retrieve a shopping bag like bag 1107 from opening 1108 when the user needs the bag for items such as groceries, for example. Integration of the container components forming shopping organizer 1100 provides a more stable and convenient platform for organized shopping, including retaining at close proximity of all of the required implements including money, coupons, payment cards, and the like in organized fashion along with organized reusable shopping bags. The integrated organizer also reduces the probability that the shopping bag carrier 1102 might be left behind in a vehicle when entering a store. or be lost or forgotten, such as left clipped to a shopping cart, for example.

Figure 12:
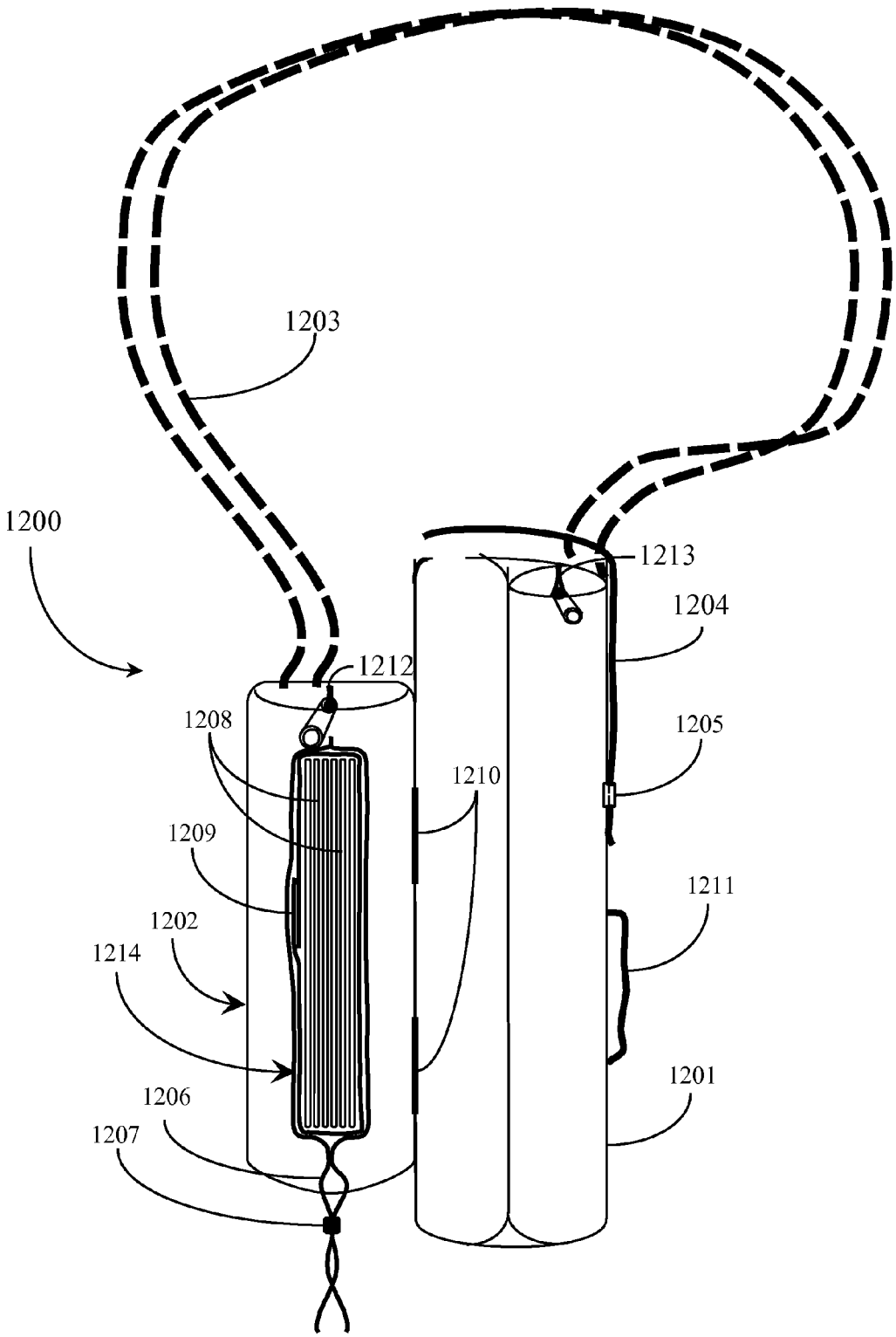
FIG. 12 is a left side elevation view of a shopping organizer according to another embodiment of the present invention.

FIG. 12 is a left side elevation view of a shopping organizer 1200 according to another embodiment of the present invention. Shopping organizer 1200 includes a purse or handbag 1201 integrated with a shopping bag carrier 1202. Components 1201 and 1202 may be fabricated from materials mentioned previously with reference to shopping organizer 1100. In this example component 1201 is a foldable purse that has an inner side with pockets and compartments for organizing money, cards, coupons, etc. in typical fashion as with many available hand bags and wallets.

Shopping bag carrier 1202 is sewn onto or otherwise attached to purse or handbag 1201 at connection points 1210. Connection points 1210 may represent a variety of actual connection hardware or mechanisms or areas of sewing. In one embodiment the integration is permanent such as by sewing, and in another embodiment the integration is modular and shopping bag carrier 1202 might be detached from bag 1201 in certain circumstances. Also in this example, bag carrier 1202 has a top with an opening that is closeable with a zipper 1212 running the length of the top. Shopping bag carrier 1202 includes at least one openable end 1214 that is closeable in this example via a drawstring 1206 with constraint element 1207. Instead of a drawstring-operated opening, there may be a zippered opening or a flap-protected opening without departing from the spirit and scope of the invention, or the opening may have no closure mechanism. There may or may not be a similar opening on the opposite end of shopping bag carrier 1202.

Visible inside the opening are multiple shopping bags (six in this example), folded and stacked together and wrapped or secured in folded and stacked position by wrap 1209. Wrap 1209 in one embodiment includes a hook and loop connector mechanism for an overlapping connection. In one embodiment wrap 1209 is a solid piece of material such as thin metal or plastic collar or sleeve having sufficient internal space to accommodate a specific number of shopping bags in a stack. In such an embodiment the shopping bags are folded, such as along permanent fold lines, and stacked together and then inserted into the collar from one the end of the stack, the collar moved to substantially a center of the stack, completely enclosing the stack. The collar may have significant surface area against the stack of bags such as taking up half of the total bag length for example.

The folded stack of bags may be somewhat compressed in storage such that when a bag is removed from the stack the stack thickness expands to take up the space occupied by the withdrawn shopping bag. In another embodiment, wrap 1209 is a spring-loaded clip that completely encloses the stack of bags and exerts some pressure against the stack of bags inside, ensuring that the stack stays organized after one or more bags are removed. In one embodiment wrap 1209 is retained within component 1202 by integration with an inside surface of the carrier, or if separate, by one or more retaining clips that may be fastened to the inside of the carrier at strategic locations to clip on to or otherwise retain the entire stack of bags within the unit while one bag is pulled free. Also, low friction coefficients of the shopping bag materials contribute to stick-free access to individual bags in the stack.

In one embodiment of the invention shopping bags that are stored into the shopping bag carrier vary from one another in one of or a combination of dimension and material makeup. For example, if shopping for groceries, a specific type of bag may be desired for holding meats and cheeses while a different type of bag might be desired to carry cereals and dry goods. In such an embodiment both types of bags may be stacked together and may be color coded on the visible end of the stack so a user knows which type of bag to pull next from the stack of bags. Color-coding may also be employed for the purpose of informing the user about bag size for different sized bags in a same stack. White may indicate a small bag, red may indicate a medium bag and black may indicate a large bag. Yellow may indicate a meat bag and green a bag for dry goods, for example.

In this implementation bag 1201 is closed by a flap attached to one side of the bag draping over the top and down the opposite side where it may be snapped to that surface using a snap connector mechanism 1205, as are many purses or bags in the art. Other connector mechanisms might be employed in place of a snap connector to close flap 1204 over component 1201. One side of foldable wallet, bag or purse 1201 may have a top opening closable by a zipper 1213 running the length of the bag. In one embodiment organizer 1200 includes a shoulder strap 1203. In this example one end of strap 1203 connects to bag 1201 and the other end to carrier 1202. In this way if the components become detached from one another (modularly integrated) they are still connected to the common strap. Shoulder strap 1203 may be sewn onto, or snapped onto, or attached by carabineer and ring, or by other method to the respective organizer components.

In one embodiment of the invention bag 1201 may have a belt sleeve 1211 sewn onto or otherwise attached to the side opposite shopping bag carrier 1202. In such an embodiment a user may decide to remove the shoulder strap and carry the organizer by belt around the waist of the user in the fashion of a money belt for example.

It will be apparent to one with skill in the art that the shopping organizer of the invention may be provided using some or all of the mentioned features and components without departing from the spirit and scope of the present invention. It will also be apparent to the skilled artisan that the embodiments described above are specific examples of a single broader invention that may have greater scope than any of the singular descriptions taught. There may be many alterations made in the descriptions without departing from the spirit and scope of the present invention.

It will also be apparent to the skilled person that the arrangement of elements and functionality for the invention is described in different embodiments in which each is exemplary of an implementation of the invention. These exemplary descriptions do not preclude other implementations and use cases not described in detail. The elements and functions may vary, as there are a variety of ways the hardware may be implemented and in which the software may be provided within the scope of the invention. The invention is limited only by the breadth of the claims below.

The invention claimed is:

1. A shopping organizer, comprising:

a purse or handbag enabled to carry cards and money;

a shopping bag carrier enclosure attached to the purse or handbag, the carrier enclosure having a shopping bag dispensing opening on one end having a width and height of opening, and a length, the carrier enclosure implemented with a closure along one side for a portion of the length, allowing the carrier enclosure to be opened to facilitate loading with a stack of folded shopping bags; and a plurality of shopping bags having common dimensions, each formed from a material having a low coefficient of friction and capable of sustaining permanent fold creases, each shopping bag formed with two flat panels joined along a bottom and opposite side edges, and open along a top edge, each bag thus exhibiting a height dimension from the bottom edge to the open top edge, and a width dimension across the opposite side edges, at a right angle to the height dimension, each bag having one or more vertical permanent fold creases from bottom to top parallel to the side edges, dividing the side panels into substantially equal portions, such that each bag when folded along the vertical permanent fold creases exhibits a folded dimension less than the length of the carrier enclosure, and each bag further having three or more permanent horizontal fold creases from side edge to opposite side edge dividing the bag into substantially equal portions such that each bag when folded along the horizontal permanent fold creases exhibits a folded dimension less than the width of opening of the carrier enclosure, the shopping bags folded along the creases and arranged in a stack; and a wrapper implemented as a fabric panel having a width and a length, attachable at one end of the length to an inner surface of the carrier enclosure with the width of the wrapper in line with the length of the carrier enclosure, the wrapper having fastening elements providing fastening the wrapper around the stack of shopping bags once the stack of shopping bags is wrapped, such that a stack of shopping bags may be wrapped in the wrapper within the carrier enclosure prior to closing;

wherein with the plurality of shopping bags each folded along both the horizontal and vertical permanent fold creases, stacked conformally, and placed in the carrier enclosure, may be grasped and pulled from the carrier enclosure one bag at a time, and opened along the permanent fold creases to be used as a shopping bag.

2. The shopping organizer of claim 1 further comprising a shoulder strap such that the purse or handbag may be slung from a user's shoulder.

3. The shopping organizer of claim 1 further comprising one or more belt loops enabling a user to carry the purse or handbag slung from a belt.

4. The shopping organizer of claim 1 wherein the carrier enclosure has two dispensing openings, one at each end of the carrier enclosure, such that individual shopping bags are retrievable from either end.

5. The shopping organizer of claim 1 wherein the dispensing opening is closable by one of a drawstring, a zipper, or a folding flap.

6. The shopping organizer of claim 1 wherein the carrier enclosure comprises a zipper opening along a length of the enclosure for inserting the stack of shopping bags into the carrier enclosure.

7. The shopping organizer of claim 2 wherein the shoulder strap is fastened at each end to one end of the purse or handbag.

8. The shopping organizer of claim 1 wherein the carrier enclosure is mounted to the purse or handbag by a releasable mechanism, such that the carrier enclosure may be released and separated from the purse or handbag.

9. The shopping organizer of claim 8 further comprising a shoulder strap fastened at one end to the purse or handbag, and at the other end is fasted to the carrier enclosure.

* * * * *